US011103765B2

(12) United States Patent
Wehrs

(10) Patent No.: US 11,103,765 B2
(45) Date of Patent: Aug. 31, 2021

(54) SCORE KEEPER AND DISPLAY DEVICE

(71) Applicant: Scorezit, LLC, Bangor, WI (US)

(72) Inventor: Chad Larry Wehrs, West Salem, WI (US)

(73) Assignee: Scorezit, LLC, Bangor, WI (US)

( * ) Notice: Subject to any disclaimer, the term of this patent is extended or adjusted under 35 U.S.C. 154(b) by 0 days.

(21) Appl. No.: 16/688,856

(22) Filed: Nov. 19, 2019

(65) Prior Publication Data

US 2021/0146224 A1 May 20, 2021

(51) Int. Cl.
*A63B 71/06* (2006.01)
*A63B 67/06* (2006.01)

(52) U.S. Cl.
CPC ..... *A63B 71/0672* (2013.01); *A63B 67/06* (2013.01)

(58) Field of Classification Search
CPC .. A63B 71/0672; A63B 67/06; A63B 71/0669
See application file for complete search history.

(56) References Cited

U.S. PATENT DOCUMENTS 3,515,092 A * 6/1970 Stengel ..... A63B 71/0672 116/223
4,331,098 A * 5/1982 Rubano ..... A63B 71/0672 116/225
5,025,748 A 6/1991 Pettis
5,385,113 A 1/1995 Hierath
6,578,513 B1 6/2003 Niksich
D518,390 S * 4/2006 Poffenberger ..... D10/46.1
7,040,623 B2 5/2006 Poffenberger
8,607,725 B2 * 12/2013 Degirmenci ..... A63B 71/0672 116/222
9,067,120 B2 * 6/2015 Huang ..... A63B 71/0672
2010/0050926 A1 3/2010 Volack et al.
2018/0193716 A1 * 7/2018 Mayotte ..... A63B 24/0062

OTHER PUBLICATIONS

Jamison Rantz, Cornhole Scoreboard, May 24, 2016, Rogue Engineer, pp. 1-28 (Year: 2016).*
Scorezit. Website, https://www.scorezit.com/, originally downloaded Oct. 1, 2019, 1 page.

* cited by examiner

*Primary Examiner* — Justin S Lee
(74) *Attorney, Agent, or Firm* — Craig R. Miles; CR Miles P.C.

(57) ABSTRACT

A score keeper and display device, and methods of making and using such a score keeper and display device, whereby the score keeper and display device includes a panel having opposing panel front and rear faces, first interconnected slots disposed within the panel to communicate between the panel front and rear faces, a first marker configured to travel between the first interconnected slots, second interconnected slots disposed within the panel to communicate between the panel front and rear faces, and a second marker configured to travel between the second interconnected slots.

21 Claims, 8 Drawing Sheets

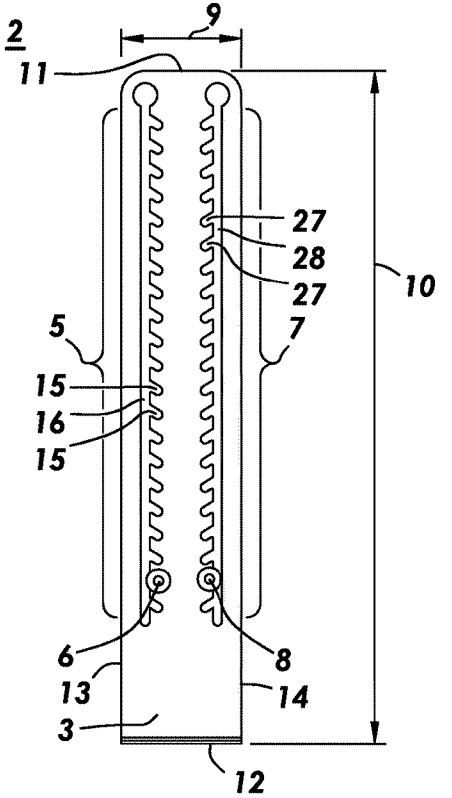
FIG.4A
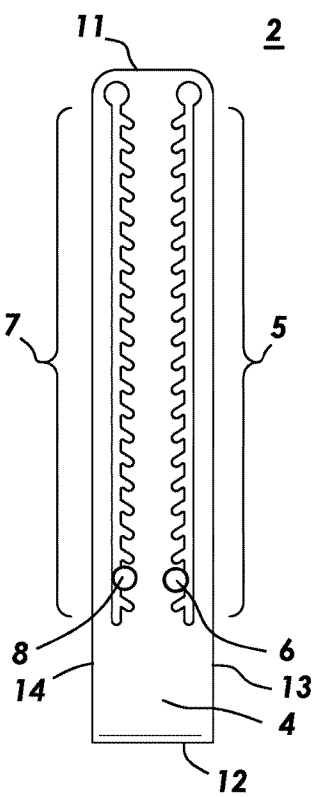
FIG.4B
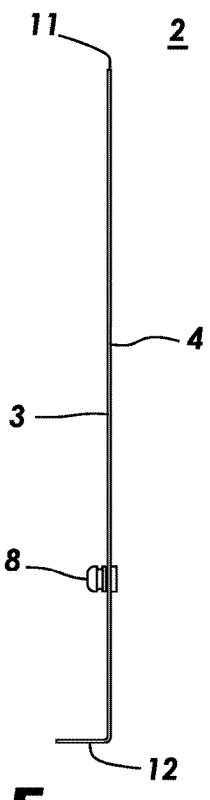
FIG.4C
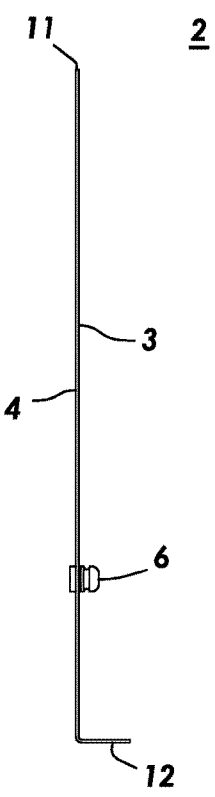
FIG.4D
FIG.4E
FIG.4F
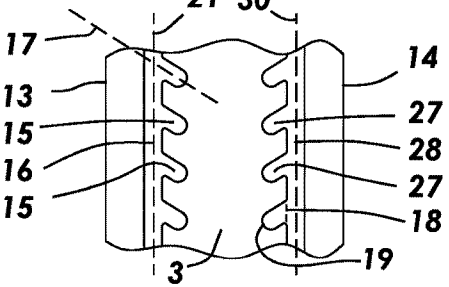
FIG.4G

SCORE KEEPER AND DISPLAY DEVICE

BRIEF SUMMARY OF THE INVENTION

A broad object of a particular embodiment of the invention can be to provide a score keeper and display device, and methods of making and using such a score keeper and display device, whereby the score keeper and display device includes a panel having opposing panel front and rear faces, first interconnected slots disposed within the panel to communicate between the panel front and rear faces, a first marker configured to travel between the first interconnected slots, second interconnected slots disposed within the panel to communicate between the panel front and rear faces, and a second marker configured to travel between the second interconnected slots.

Naturally, further objects of the invention are disclosed throughout other areas of the specification, drawings, and claims.

BRIEF DESCRIPTION OF THE DRAWINGS

FIG. 4A is a front view of a particular embodiment of a panel of the score keeper and display device.

FIG. 4B is a rear view of the particular embodiment of the panel shown in FIG. 4A.

FIG. 4C is a first side view of the particular embodiment of the panel shown in FIG. 4A.

FIG. 4D is a second side view of the particular embodiment of the panel shown in FIG. 4A.

FIG. 4E is a top view of the particular embodiment of the panel shown in FIG. 4A.

FIG. 4F is a bottom view of the particular embodiment of the panel shown in FIG. 4A.

FIG. 4G is an enlarged view of a portion of the panel shown in FIG. 4A.

DETAILED DESCRIPTION OF THE INVENTION

Figure 1:
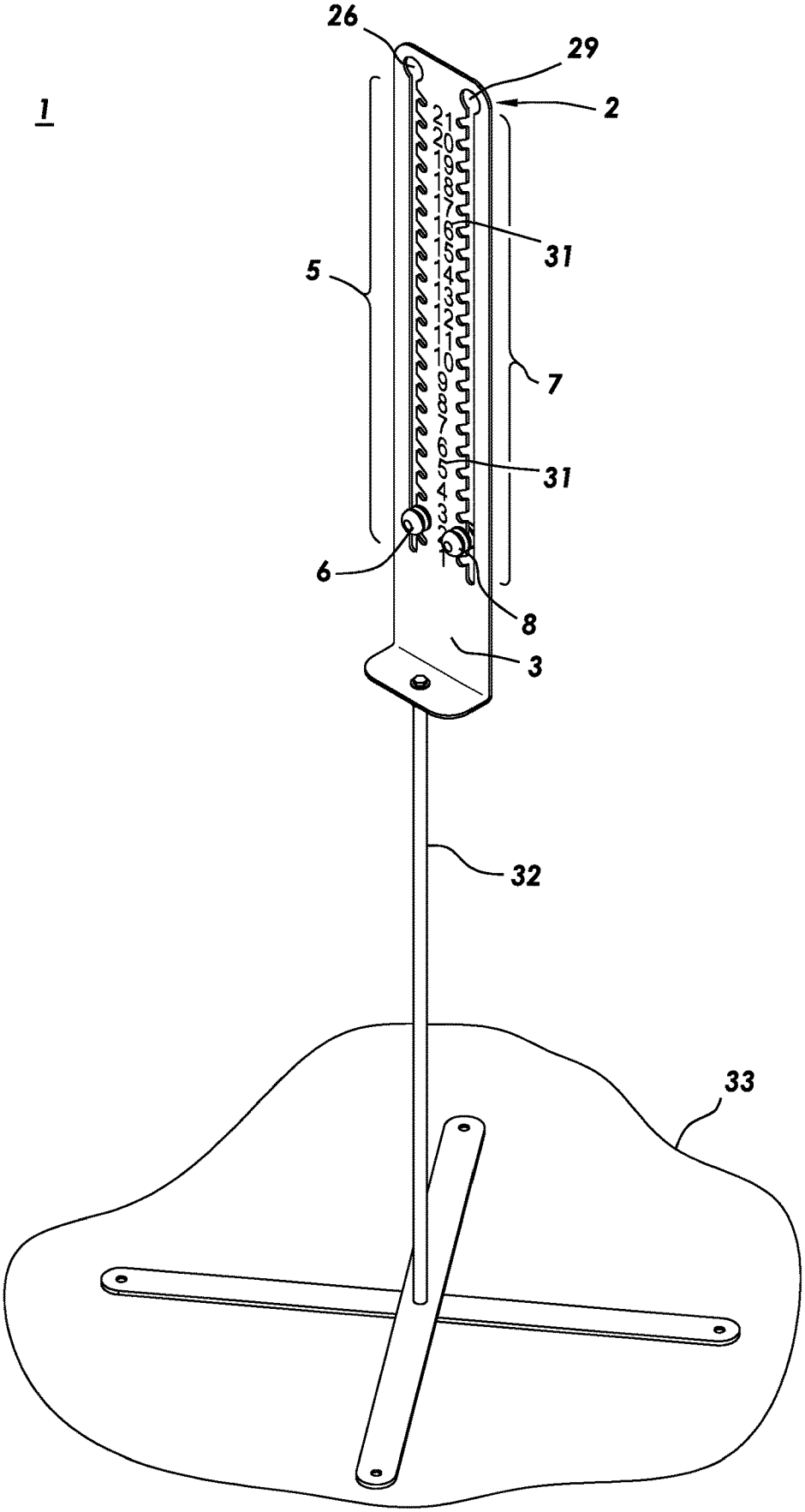
FIG. 1 is a front perspective view of a particular embodiment of the score keeper and display device.
Figure 2D:
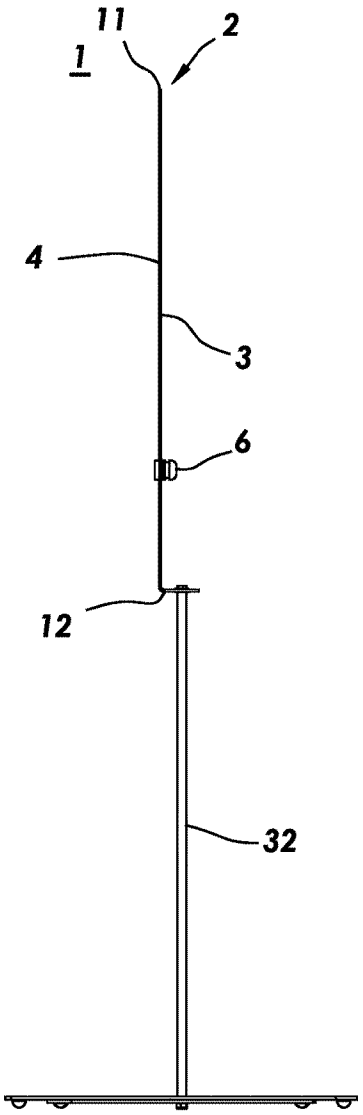
FIG. 2D is a second side view of the particular embodiment of the score keeper and display device shown in FIG. 2A.
Figure 2C:
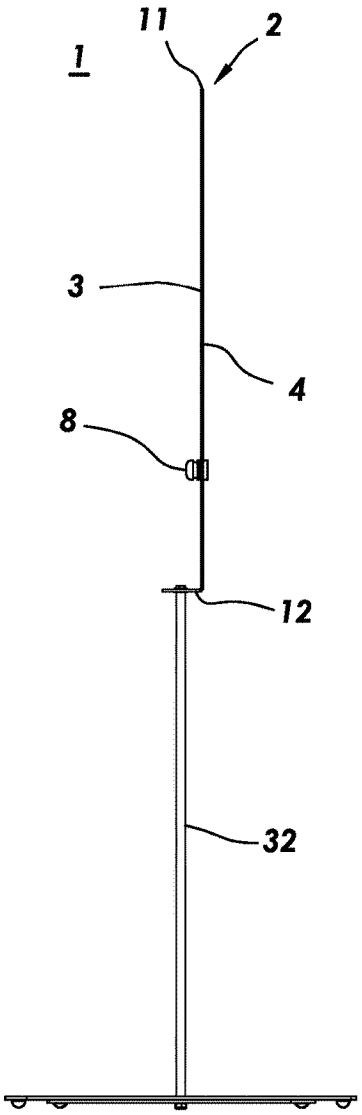
FIG. 2C is a first side view of the particular embodiment of the score keeper and display device shown in FIG. 2A.
Figure 2B:
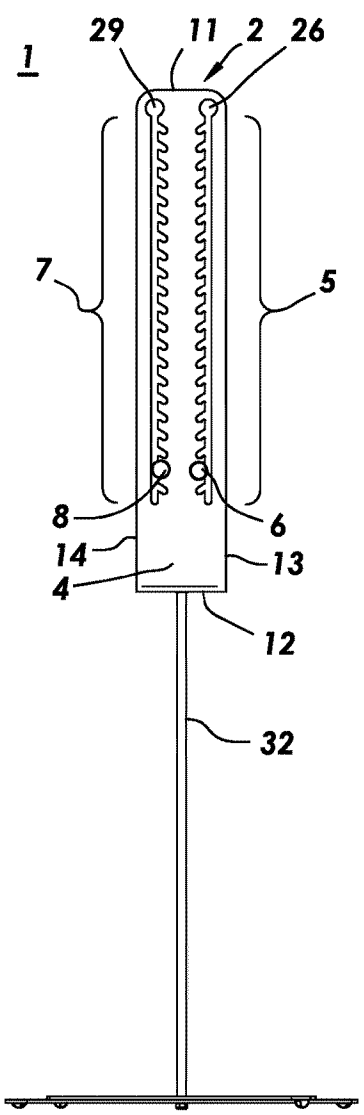
FIG. 2B is a rear view of the particular embodiment of the score keeper and display device shown in FIG. 2A.
Figure 2A:
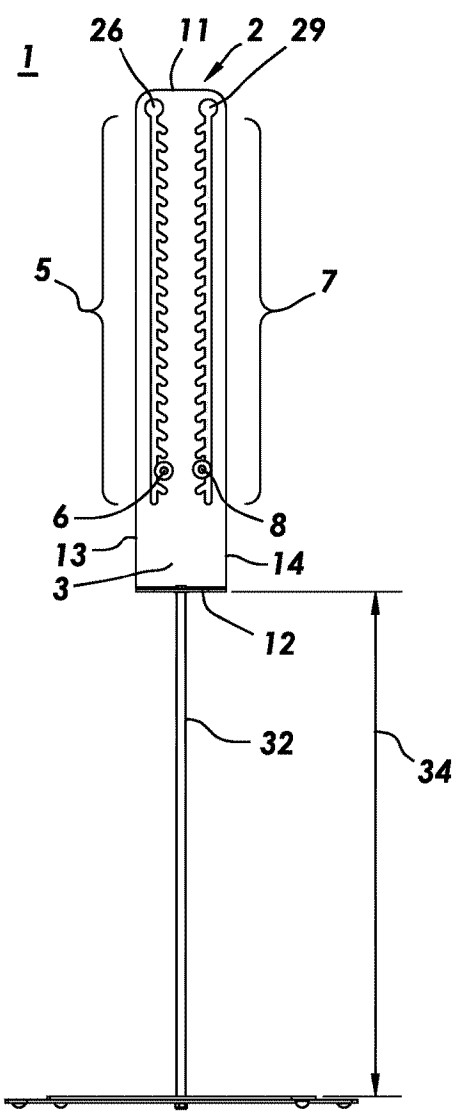
FIG. 2A is a front view of a particular embodiment of the score keeper and display device.
Figure 2E:
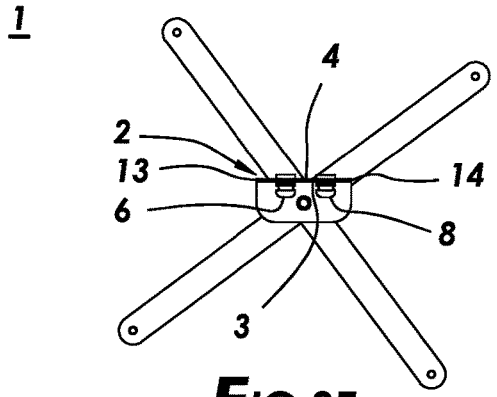
FIG. 2E is a top view of the particular embodiment of the score keeper and display device shown in FIG. 2A.
Figure 2F:
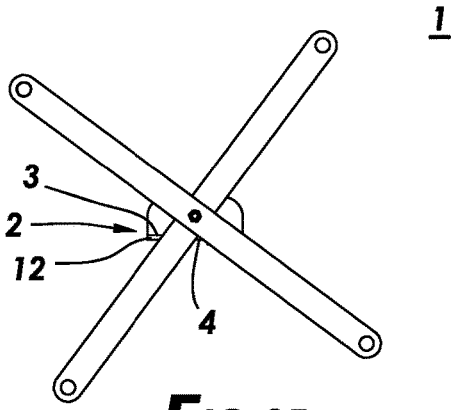
FIG. 2F is a bottom view of the particular embodiment of the score keeper and display device shown in FIG. 2A.
Figure 6A:
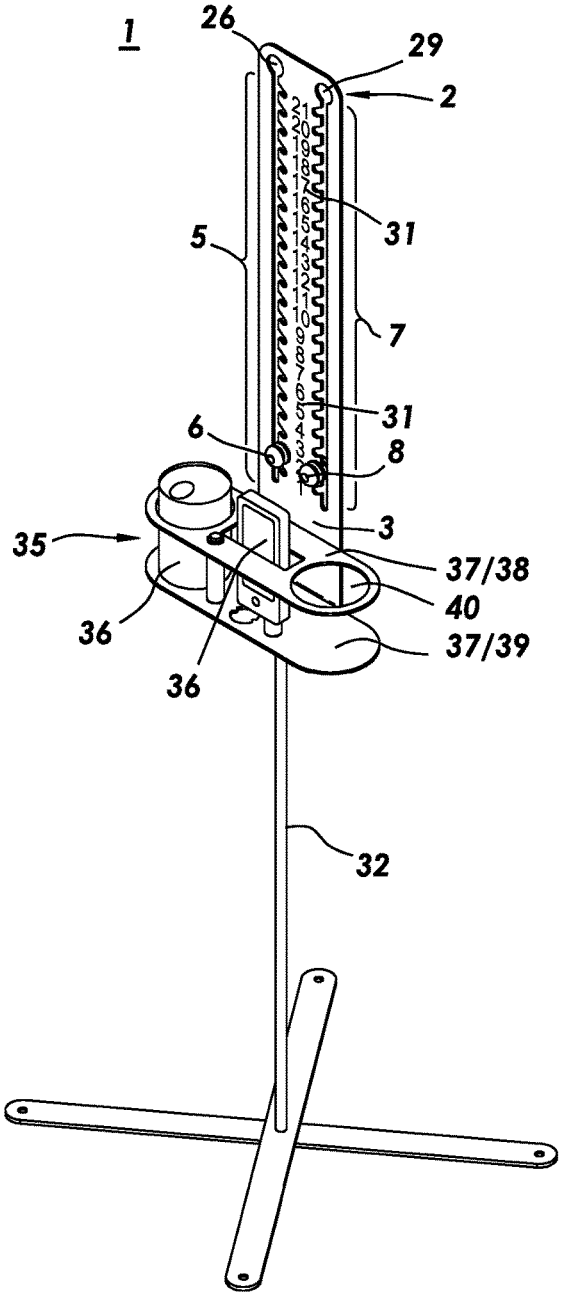
FIG. 6A is a front perspective view of a particular embodiment of the score keeper and display device which includes an auxiliary support.
Figure 6B:
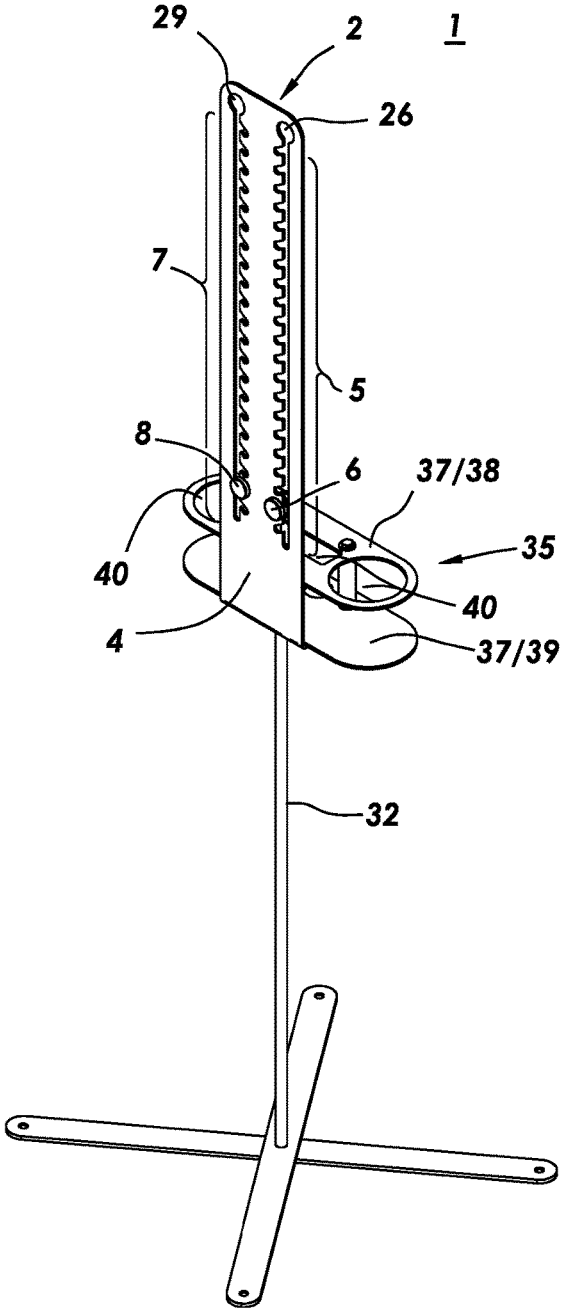
FIG. 6B is a rear perspective view of the particular embodiment of the score keeper and display shown in FIG. 6A.
Figure 6E:
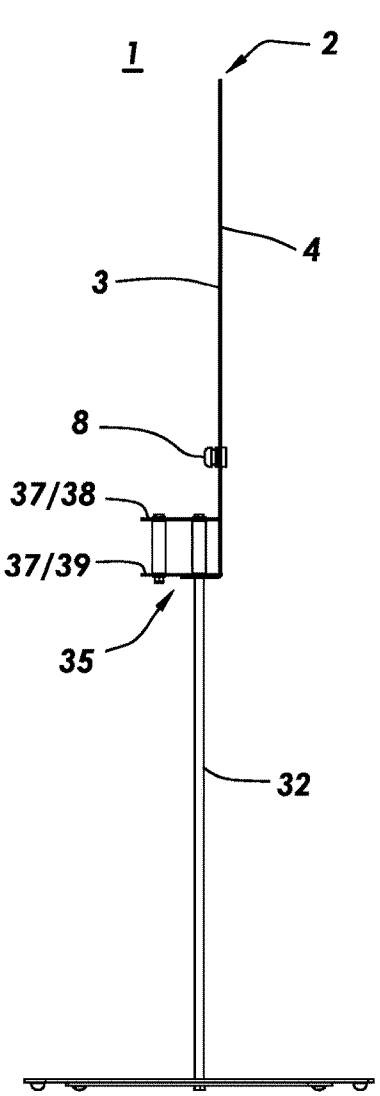
FIG. 6E is a side view of the particular embodiment of the score keeper and display device shown in FIG. 6C.
Figure 6D:
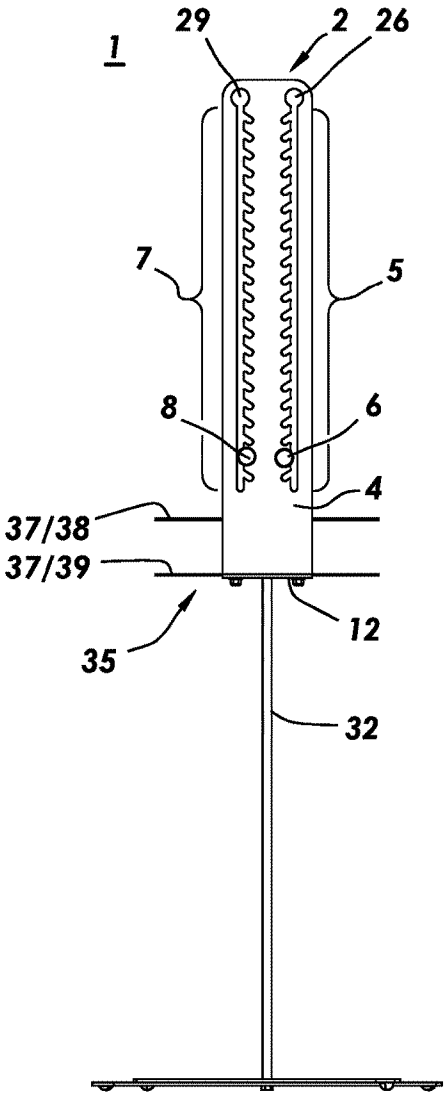
FIG. 6D is a rear view of the particular embodiment of the score keeper and display device shown in FIG. 6C.
Figure 6C:
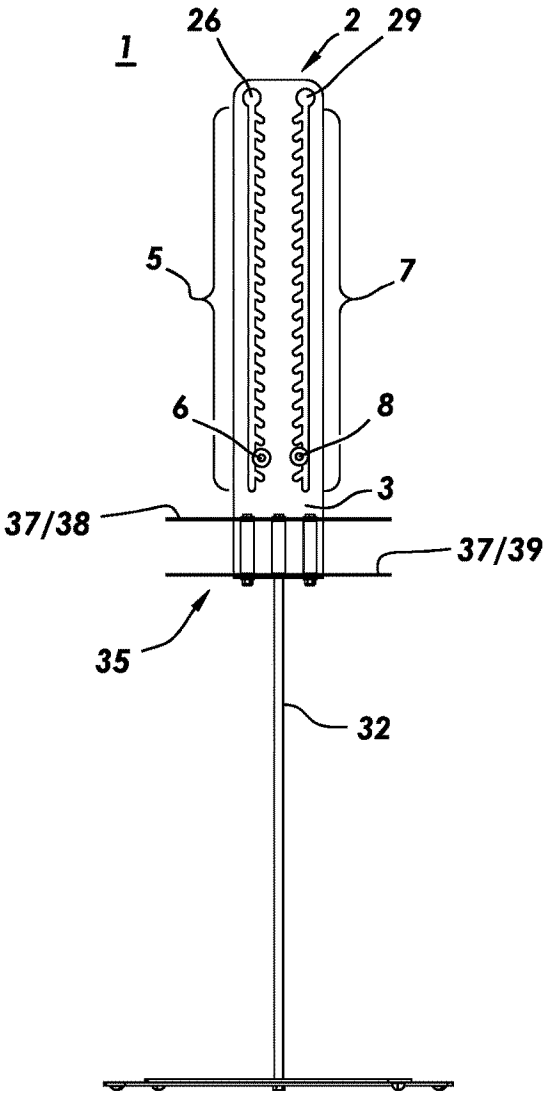
FIG. 6C is a front view of a particular embodiment of the score keeper and display device which includes an auxiliary support.
Figure 7:
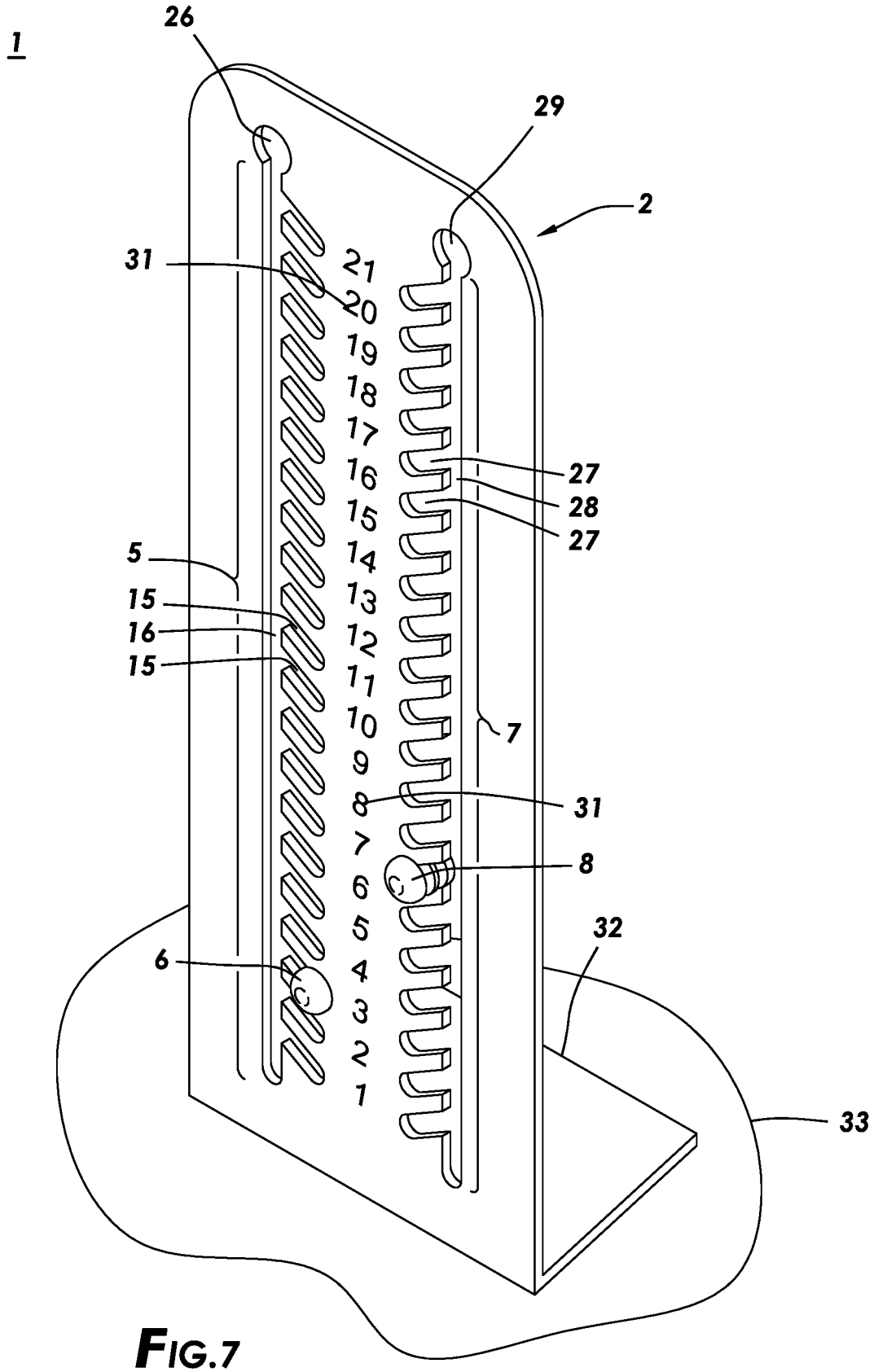
FIG. 7 is a front perspective view of a particular embodiment of the score keeper and display device which includes a planar panel support rearwardly extending from the panel.

Now referring primarily to FIGS. 1, 6A, and 7, which illustrate particular embodiments of the inventive score keeper and display device (1) including a panel (2) having opposing panel front and rear faces (3)(4), first interconnected slots (5) disposed within the panel (2) and communicating between the panel front and rear faces (3)(4), and a first marker (6) configured to travel between the first interconnected slots (5). When a game is played, the score of a first player can be kept by moving the first marker (6) from one of the first interconnected slots (5) to another of the first interconnected slots (5), whereby the slot to which the first marker (6) is moved can indicate and display the score of the first player, thus allowing this score to be known by the first player, an opponent (such as a second player), and spectators.

The score keeper and display device (1) can further include second interconnected slots (7) disposed within the panel (2) and communicating between the panel front and rear faces (3)(4), and a second marker (8) configured to travel between the second interconnected slots (7). In use, the score of a second player can be kept by moving the second marker (8) from one of the second interconnected slots (7) to another of the second interconnected slots (7), whereby the slot to which the second marker (8) is moved can indicate and display the score of the second player, correspondingly allowing this score to be known by the second player, an opponent (such as the first player), and spectators.

As but one illustrative example of a multitude of applications, the score keeper and display device (1) detailed herein may be used while playing cornhole, also known as bean bag toss, corn toss, baggo or bags, whereby this game can be played primarily outdoors and can involve players taking turns pitching weighted bags at a sloping target with an aperture in the distal end.

More specifically, cornhole comprises two angled boards, typically made of wood, located in spaced apart relation. As per the American Cornhole Association, each board can be a 47.5 to 48 inch by 23.5 to 24 inch rectangle, whereby the front of the board can be three to four inches from bottom to top, the back of the board can be approximately twelve inches from ground to the highest point of the board, and the hole in the board can be six inches in diameter, with its center nine inches from the top and twelve inches from each side of the board.

For play, the boards can be spaced with 27 feet between the front of each board. Each players can stand beside one of the boards and the players can take turns pitching a small bag filled with dried beans, corn, or other pellets toward the opposing board, attempting to place the bag either on the playing surface of the opposing board for a score of one point or in the hole of the opposing board for a score of three points.

Concerning scoring, after both players have alternately pitched their bags toward the opposing board to complete one inning of play, the difference in score between the two players can be added to the score of that player who scored the most points in that inning. For example, if the first player scores three points and the second player scores five points, then the second player adds two points to their score. Following, the two players play another inning, whereby the game is played until one of the players achieves a winning score, such as a score of 21 points.

The instant score keeper and display device (1) can facilitate keeping of the score during the course of a game, such as cornhole, as the score keeping may be confusing and/or result in errors in the absence of a score keeping device. Additionally, the instant score keeper and display device (1) can enable spectators to readily determine the score throughout the course of the game.

Now referring primarily to FIGS. 1 through 4G, the score keeper and display device (1) includes a panel (2) having opposing panel front and rear faces (3)(4) which may be substantially planar (or flat). As to particular embodiments, the panel (2) can be an elongate panel (2). As to particular embodiments, the elongate panel (2) may be configured as substantially rectangular (or have a substantially rectangular cross-section) with a substantially constant width (9) along its length (10). However, the panel (2) need not be limited to this particular configuration.

Now referring primarily to FIG. 4A, structurally, the panel length (10) and the panel width (9) can be defined by a top edge (11) connected to an opposing bottom edge (12) by opposing left and right edges (13)(14), all edges (11)(12)(13)(14) together providing the outer perimeter of the panel (2).

As to particular embodiments, the panel (2) can be a one-piece or single or monolithic or integrated construct, meaning seamlessly continuous between edges (11)(12)(13)(14).

Now referring primarily to FIGS. 1 through 4G, the score keeper and display device (1) further includes first interconnected slots (5) or a plurality of first slots (15) interconnected with one another by a first interconnection (16) (which can be configured as an elongate aperture element), whereby the first interconnection (16) can facilitate travel or movement between the first slots (15) and in particular, substantially planar travel between the first slots (15). Correspondingly, the first slots (15) and the first interconnection (16) can dispose in coplanar relation. The instant first interconnected slots (5) may be contrasted with a plurality of discretely bound openings which are consequently unconnected, thus precluding planar travel therebetween.

Now referring primarily to FIG. 4G, structurally, each first slot (15) can be configured as an elongate aperture element having a first slot longitudinal axis (17) which passes through first slot first and second ends (18)(19), whereby the first slot first end (18) communicates with the first interconnection (16) and the first slot second end (19) provides a seat for the first marker (6).

The term "longitudinal axis" as used herein means an axis that extends along the length of an object. Of note, the term "longitudinal axis" as used herein need not mean a centrally-located longitudinal axis, and if a centrally-located longitudinal axis is meant, it will be explicitly described as such.

The first interconnected slots (5) can be disposed in the panel (2) such that each first slot (15) communicates between the panel front and rear faces (3)(4), correspondingly providing a passageway therebetween. Additionally, the first interconnection (16) can be disposed in the panel (2) to also communicate between the panel front and rear faces (3)(4) as well as between the first slots (15).

As to particular embodiments, the first interconnected slots (5) can be completely laterally enclosed within the panel (2) (or completely surrounded by the panel (2)), meaning that the first interconnected slots (5) communicate between only the panel front and rear faces (3)(4) and with the first interconnection (16), and do not communicate with the edges (11)(12)(13)(14) or outer perimeter of the panel (2). Said another way, both the first slots (15) and the first interconnection (16) can be completely laterally enclosed within the panel (2), correspondingly communicating between only the panel front and rear faces (3)(4), and not communicating with the edges (11)(12)(13)(14) or outer perimeter of the panel (2).

Figure 3A:
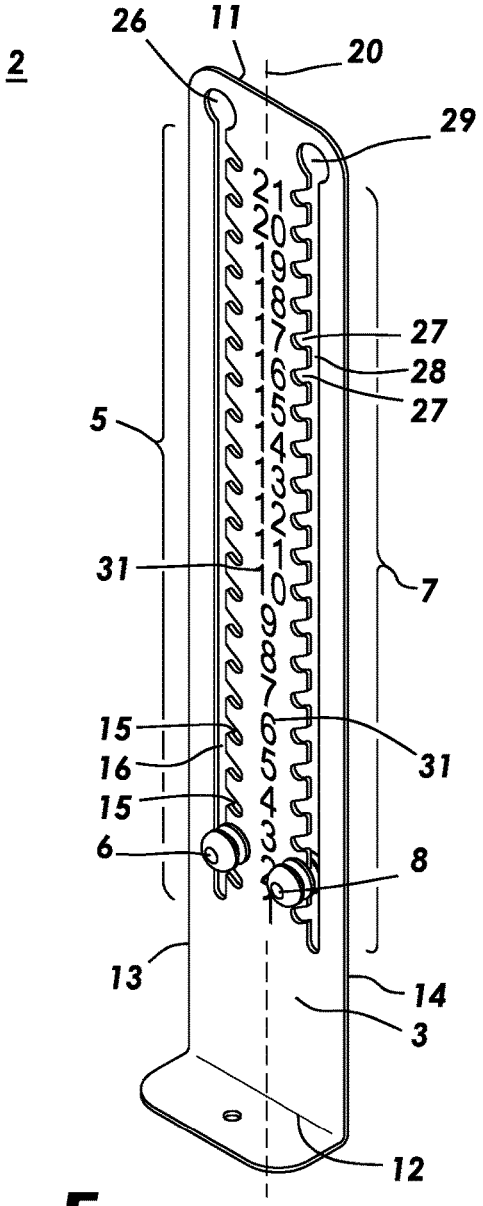
FIG. 3A is a front perspective view of a particular embodiment of a panel of the score keeper and display device.

Now referring primarily to FIG. 3A, the first slots (15) can be aligned with one another along a panel longitudinal axis (20). Specifically, the first slot first ends (18) can be aligned with one another along a panel longitudinal axis (20), and the first slot second ends (19) can be aligned with one another along a panel longitudinal axis (20).

As to particular embodiments wherein a panel longitudinal axis (20) disposes substantially vertically when the score keeper and display device (1) is in use, the first slots (15) can be vertically aligned with one along the panel length (10), (or the first slot first ends (18) can be vertically aligned with one another along the panel length (10), and the first slot second ends (19) can be vertically aligned with one another along the panel length (10)) (as shown in the examples of the Figures). Of course, it is herein contemplated that the first slots (15) can also be horizontally aligned with one another along the panel length (10), for example in particular embodiments in which a panel longitudinal axis (20) disposes substantially horizontally when the score keeper and display device (1) is in use (not shown).

Figure 3B:
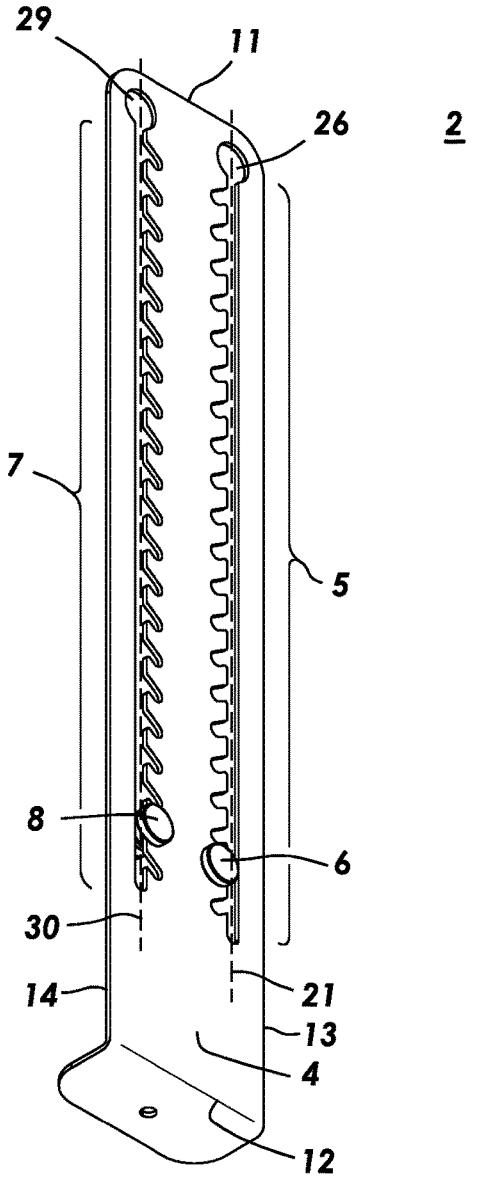
FIG. 3B is a rear perspective view of the particular embodiment of the panel shown in FIG. 3A.
Figure 5B:
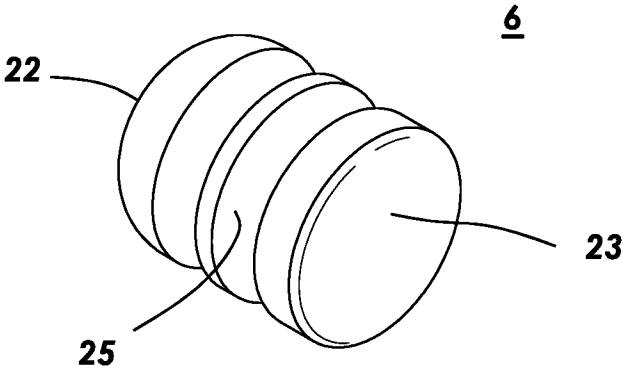
FIG. 5B is a rear perspective view of the particular embodiment of the marker shown in FIG. 5A.
Figure 5A:
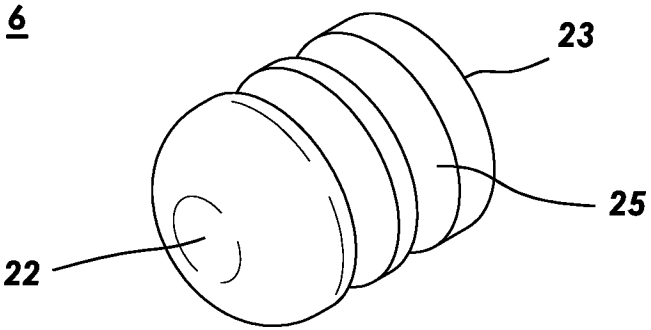
FIG. 5A is a front perspective view of a particular embodiment of a marker of the score keeper and display device.
Figure 5E:
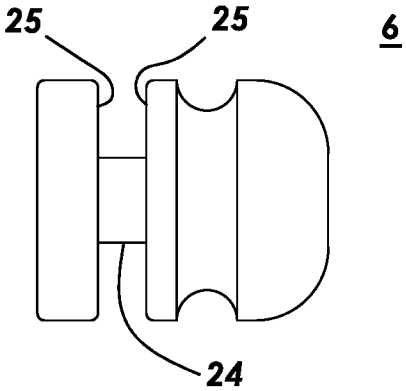
FIG. 5E is a side view of the particular embodiment of the marker shown in FIG. 5A.
Figure 5D:
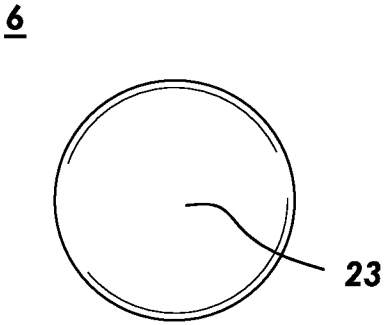
FIG. 5D is a rear view of the particular embodiment of the marker shown in FIG. 5A.
Figure 5C:
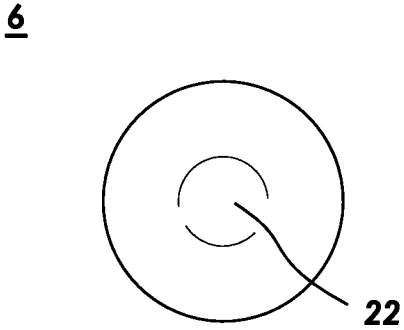
FIG. 5C is a front view of the particular embodiment of the marker shown in FIG. 5A.

Now referring primarily to FIG. 3B, a first interconnection longitudinal axis (21) can dispose in substantially parallel relation to a panel longitudinal axis (20). As to particular embodiments wherein a panel longitudinal axis (20) disposes substantially vertically when the score keeper and display device (1) is in use, the first interconnection (16) can be vertically disposed within the panel (2) (as shown in the examples of the Figures). Of course, it is herein contemplated that the first interconnection (16) can also be horizontally disposed within the panel (2), for example in particular embodiments in which a panel longitudinal axis (20) disposes substantially horizontally when the score keeper and display device (1) is in use (not shown).

Now referring primarily to FIGS. 4A and 4G, as to particular embodiments, the first slots (15) can be disposed in angled relation to the first interconnection (16). Moreover, a first slot longitudinal axis (17) can dispose in angled relation to a first interconnection longitudinal axis (21). As to particular embodiments, the angle may not be (i) 0° (in which case a first slot longitudinal axis (17) would dispose in parallel relation to a first interconnection longitudinal axis (21)) or (ii) ±90° (in which case a first slot longitudinal axis (17) would dispose in orthogonal relation to a first interconnection longitudinal axis (21)).

As to particular embodiments wherein a panel longitudinal axis (20) disposes substantially vertically when the score keeper and display device (1) is in use, a first slot longitudinal axis (17) can dispose in angled relation to a first interconnection longitudinal axis (21) such that the first slot first end (18) angles upwardly from the first slot second end (19). As to particular embodiments, a first slot longitudinal axis (17) can dispose at an angle of less than 0° and greater than about −90° in relation to a first interconnection longitudinal axis (21). As to particular embodiments, a first slot longitudinal axis (17) can dispose at an angle of less than about −20° and greater than about −70° in relation to a first interconnection longitudinal axis (21). With the first slot (15) diagonally oriented as such, to move the first marker (6) between first slots (15), application of an upwardly-directed force and a laterally-directed force to the first marker (6) is required to displace the first marker (6) from its seat (or the first slot second end (19)); following, this first slot orientation can provide a more secure seat in which the first marker (6) may be less prone to undesirable movement in relation to a horizontally-oriented first slot (having a substantially horizontal first slot longitudinal axis) which mandates only the application of a laterally-directed force to displace the first marker (6) from its seat.

Now referring primarily to FIGS. 5A through 5E, the score keeper and display device (1) can further include a first marker (6) configured to travel between the first interconnected slots (5), whereby the first slot (15) where the first marker (6) resides indicates and displays the score of the first player. Structurally, the first marker (6) can include first marker first and second ends (22)(23) and a first marker intermediate portion (24) disposed therebetween. Additionally, the first marker first and second ends (22)(23) can have a greater outer perimeter and/or a greater diameter than the first marker intermediate portion (24). Moreover, the first marker first and second ends (22)(23) can have a greater cross-sectional area than the first marker intermediate portion (24).

Concerning the latter, the first marker intermediate portion (24) can be configured and sized to extend through and travel between the first interconnected slots (5). Additionally, the first marker intermediate portion (24) can be configured and sized to engage with the first slot second end (19) for seating and corresponding residence therewithin.

Each of the first marker first and second ends (22)(23) can include a stop surface (25) which functions as a stop element to preclude passage through the first interconnected slots (5). Accordingly, the first marker first end (22) can be coupled to the first intermediate portion (24) and can prevent the first marker (6) from completely passing through the first interconnected slots (5) from the panel front face (3) to the panel rear face (4). Similarly, the first marker second end (23) can be coupled to the first intermediate portion (24) and can prevent the first marker (6) from completely passing through the first interconnected slots (5) from the panel rear face (4) to the panel front face (3).

As to particular embodiments, the first marker (6) can be a one-piece or single or monolithic or integrated construct, meaning typically inseparable under normal conditions during routine use. As to these embodiments, the score keeper and display device (1) can further include a first entry port (26) disposed within the panel (2) to communicate (i) between the panel front and rear faces (3)(4), and (ii) with the first interconnected slots (5), whereby the first entry port (26) can be configured and sized such that the first marker first end (22) and/or the first marker second end (23) can be passed therethrough.

Following, the first marker (6) can be disposed within the first interconnected slots (5) by passing the first marker first or second end (22)(23) through the first entry port (26) to dispose the first marker intermediate portion (24) within the first entry port (26). Subsequently, the first marker (6) can be moved from the first entry port (26) into the first interconnection (16) and the first slots (15).

As to particular embodiments wherein a panel longitudinal axis (20) disposes substantially vertically when the score keeper and display device (1) is in use, the first entry port (26) can be disposed above the first interconnection (16).

As to other particular embodiments, the first marker first and second ends (22)(23) can be separable from one another; thus, when in a dissembled state, the first marker first end (22) can be physically separated from the first marker second end (23). Upon assembly, the first marker first and second ends (22)(23) can be fixedly coupled together, whereby this coupling may be via the first marker intermediate portion (24).

As to particular embodiments, the first marker first end (22) can be integrated with the first marker intermediate portion (24). Subsequently, the integrated first marker first end (22) and first marker intermediate portion (24) can be separable from the first marker second end (23). For assembly of the score keeper and display device (1), the first marker intermediate portion (24) can be passed through the first interconnected slots (5) from the panel front surface (3) toward the panel rear surface (4), whereby the passage can be arrested when the stop surface (25) of the first marker first end (22) abuts the panel front face (3). Following, the first marker (6) can be secured within the first interconnected slots (5) by coupling the first marker second end (23) with the first marker intermediate portion (24) proximate the first panel rear face (4).

As to other particular embodiments, the first marker second end (23) can be integrated with the first marker intermediate portion (24). Subsequently, the integrated first marker second end (23) and first marker intermediate portion (24) can be separable from the first marker first end (22). For assembly of the score keeper and display device (1), the first marker intermediate portion (24) can be passed through the first interconnected slots (5) from the panel rear surface (4) toward the panel front surface (3), whereby the passage can be arrested when the stop surface (25) of the first marker second end (23) abuts the panel rear face (4). Following, the first marker (6) can be secured within the first interconnected slots (5) by coupling the first marker first end (22) with the first marker intermediate portion (24) proximate the first panel front face (3).

As to particular embodiments, the first marker intermediate portion (24) can couple to the separate first marker first or second end (22)(23) by threads.

Whether a one-piece construct or an assemblable construct, the first marker (6), once disposed within the first interconnected slots (5), can be considered fixedly or inseparably coupled to the panel (2) to provide a unitary construct, which can mean that the first marker (6) cannot be separated from the panel (2) accidentally or with relative ease. This unitary construct may be advantageous relative to a score keeper and/or display device with multiple discrete components which are not fixedly coupled together, as components of the latter configuration may be more easily misplaced or lost.

Now referring primarily to FIGS. 1 through 4F, the score keeper and display device (1) can further include second interconnected slots (7) or a plurality of second slots (27) interconnected with one another by a second interconnection (28), whereby particular embodiments of the invention can have second interconnected slots (7) which are similar or identical to the first interconnected slots (5) detailed above; thus, the above description of the first interconnected slots (5) may be extrapolated to the second interconnected slots (7).

In addition, the score keeper and display device (1) can further include a second marker (8) configured to travel between the second interconnected slots (7), whereby particular embodiments of the invention can have a second marker (8) which is similar or identical to the first marker (6) detailed above; thus, the above description of the first marker (6) may be extrapolated to the second marker (8).

Moreover, the score keeper and display device (1) can further include a second entry port (29) disposed within the panel (2) to communicate (i) between the panel front and rear faces (3)(4), and (ii) with the second interconnected slots (7), whereby the second entry port (29) can be configured and sized such that one or more ends of the second marker (8) can be passed therethrough. As to particular embodiments, the second entry port (29) can be similar or identical to the first entry port (26) detailed above; thus, the above description of the first entry port (26) may be extrapolated to the second entry port (29).

Now referring primarily to FIGS. 3A and 3B, the first and second interconnected slots (5)(7) can dispose in substantially parallel spaced apart relation, for example such that first and second interconnection longitudinal axes (21)(30) dispose in substantially parallel spaced apart relation.

As to particular embodiments wherein a panel longitudinal axis (20) disposes substantially vertically when the score keeper and display device (1) is in use, the first and second interconnected slots (5)(7) can dispose in substantially parallel laterally spaced apart relation, for example such that first and second interconnection longitudinal axes (21)(30) dispose in substantially parallel laterally spaced apart relation.

Again referring primarily to FIGS. 3A and 3B, the first and second interconnected slots (5)(7) can align with one another such that each of the first slots (15) aligns with a corresponding second slot (27). As to particular embodiments wherein a panel longitudinal axis (20) disposes substantially vertically when the score keeper and display device (1) is in use, each first slot (15) can be horizontally aligned with a corresponding second slot (27) along the panel width (9) (as shown in the examples of the Figures).

Now referring primarily to FIGS. 1, 3A, 6A, and 7, as to particular embodiments, the score keeper and display device (1) can further include a plurality of score indicium (31) (or score indicia) coupled to the panel (2), whereby each score indicium (31) can be associated with one of the first slots (15) and/or one of the second slots (27). As but one illustrative example, the score indicia (31) can comprise serial integers from 1 to 21.

As to particular embodiments wherein a panel longitudinal axis (20) disposes substantially vertically when the score keeper and display device (1) is in use, the score indicia (31) can be configured as a single column of serial integers disposed between the first and second interconnected slots (5)(7), whereby the same score indicium (31) can indicate the score represented by horizontally aligned first and second slots (15)(27).

Now referring primarily to FIGS. 1 through 2F, and 6A through 7, as to particular embodiments, the score keeper and display device (1) can further include a panel support (32) coupled to, connected to, directly connected to, or integrated with the panel (2), whereby the panel support (32) can be configured to support the panel (2) in an upright position.

Now referring primarily to FIG. 7, the panel support (32) can be configured to dispose in substantially horizontal relation when supporting the panel (2) in an upright position. As but one illustrative example, the panel support (32) can be a substantially planar extension of the panel (2) which can extend from the bottom edge (12) of the panel (2), for example rearwardly, to (i) contact the surface (33) on which the panel (2) is disposed and (ii) support the panel (2) in an upright position on the surface (33). As to this particular embodiment, when engaged with the surface (33), the panel support (32) can dispose the panel (2) relatively close to the surface (33).

As to particular embodiments, the panel support (32) can be integrated with the panel (2) such that the panel (2) and panel support (32) can be a one-piece or single or monolithic or integrated construct, meaning typically inseparable under normal conditions during routine use.

Now referring primarily to FIGS. 1 through 2F, and 6A through 6E, as to other particular embodiments, the panel support (32) can be configured to dispose in substantially vertical relation when supporting the panel (2) in an upright position. As but one illustrative example, the panel support (32) can be configured as an elongate member which can extend from the bottom edge (12) of the panel (2), for example downwardly, toward the surface (33). As to this particular embodiment, when engaged with the surface (33), the panel support (32) can dispose the panel (2) a distance above the surface (33), particularly in relation to the embodiment of the instant invention shown in FIG. 7.

As shown in the examples of FIGS. 1 through 2F, and 6A through 7, the panel support (32) can engage with the surface (33) by resting on top of the surface (33). Alternatively, the panel support (32) can extend into the surface (33), for example via a pointed distal end which can be driven into the surface (33) (not shown).

As to particular embodiments, the panel support (32) can have an adjustable panel support length (34) to vary the height at which the panel (2) disposes above the surface (33) during play. As but one illustrative example, the panel support (32) can be configured as a plurality of elongate members which can engage with one another, for example telescopingly, to vary the overall panel support length (34).

Now referring primarily to FIGS. 6A through 6E, as to particular embodiments, the score keeper and display device (1) can further include an auxiliary support (35) coupled to, connected to, directly connected to, or integrated with the panel (2), whereby the auxiliary support (35) can be configured to support an auxiliary object(s) (36) which may be desired by a player(s) while playing a game.

As to particular embodiments, the auxiliary support (35) can include a substantially planar surface (37) which can be coupled to the panel (2) to dispose in substantially orthogonal relation to the panel front face (3) and/or the panel rear face (4). As to particular embodiments, the auxiliary support (35) can be coupled to the panel (2) proximate the bottom edge (12) of the panel (2) and can frontwardly extend from the panel front face (3).

As to particular embodiments, the auxiliary support (35) can include a pair of substantially planar surfaces (37) which can be coupled together to dispose in spaced apart relation. As to particular embodiments, the pair of substantially planar surfaces (37) can dispose in vertically spaced apart relation; thus, the pair of substantially planar surfaces (37) can include an upper planar surface (38) and a lower planar surface (39).

As to particular embodiments, the auxiliary support (35) can further include one or more apertures (40) disposed in the upper planar surface (38), whereby an aperture (40) can be configured and sized to support an auxiliary object (36). As but one illustrative example, an aperture (40) can have a generally circular cross-section, which may be useful for supporting an auxiliary object (36) configured as a beverage container received therein. As but a second illustrative example, an aperture (40) can have a generally rectangular cross-section, which may be useful for supporting an auxiliary object (36) configured as a mobile device received therein.

Method of Making

Now regarding production, a method of making a particular embodiment of the instant score keeper and display device (1) includes providing a panel (2) having opposing panel front and rear faces (3)(4), disposing first interconnected slots (5) within the panel (2) to communicate between the panel front and rear faces (3)(4), and providing a first marker (6) configured to travel between the first interconnected slots (5). The method of making can further include disposing second interconnected slots (7) within the panel (2) to communicate between the panel front and rear faces (3)(4), and providing a second marker (8) configured to travel between the second interconnected slots (7).

The method of making particular embodiments of the score keeper and display device (1) can further include providing additional components of the score keeper and display device (1) as described above and in the claims.

The panel (2) can be formed from a numerous and wide variety of materials which are of sufficient rigidity to stand upright and support the first and second interconnected slots (5)(7) and the first and second markers (6)(8) disposed therein. As but a few illustrative examples, the panel (2), as well as the additional components herein detailed, can be formed from (i) metal, such as a rust-resistant or rust-proof metal, (ii) wood, (iii) plastic, (iv) polymers, or combinations thereof.

Method of Using

Now regarding use, a method of using a particular embodiment of the instant score keeper and display device (1) includes obtaining the panel (2) above described, supporting the panel (2) on a surface (33) in an upright position, and moving the first marker (6) within the first interconnected slots (5) to indicate a position of a first player of a game. Further, the method of use can include moving the second marker (8) within the second interconnected slots (7) to indicate a position of a second player of the game.

The method of using particular embodiments of the score keeper and display device (1) can further include additional steps as described above and in the claims.

As can be easily understood from the foregoing, the basic concepts of the present invention may be embodied in a variety of ways. The invention involves numerous and varied embodiments of a score keeper and display device and methods for making and using such a score keeper and di splay device.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or a method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupler" and even a "means for coupling." Such alternative terms for each element or step are to be understood to be explicitly included in the description.

In addition, as to each term used, it should be understood that unless its utilization in this application is inconsistent with such interpretation, common dictionary definitions should be understood to be included in the description for each term as contained in Merriam-Webster's Dictionary, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about", it will be understood that the particular value forms another embodiment. The term "about" generally refers to a range of numeric values that one of skill in the art would consider equivalent to the recited numeric value or having the same function or result. Similarly, the antecedent "substantially" or "generally" means largely, but not wholly, the same form, manner or degree and the particular element will have a range of configurations as a person of ordinary skill in the art would consider as having the same function or result. When a particular element is expressed as an approximation by use of the antecedent "substantially" or "generally", it will be understood that the particular element forms another embodiment. For example, a "substantially" planar surface denotes one embodiment with a substantially planar surface and one embodiment with a planar surface.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Thus, the applicant should be understood to claim at least: (i) each embodiment of the score keeper and display device herein disclosed and described, (ii) the related methods disclosed and described, (iii) similar, equivalent, and even implicit variations of each of these apparatuses and methods, (iv) those alternative embodiments which accomplish each of the functions shown, disclosed, or described, (v) those alternative designs and methods which accomplish each of the functions shown as are implicit to accomplish that which is disclosed and described, (vi) each feature, component, and step shown as separate and independent inventions, (vii) the applications enhanced by the various systems or components disclosed, (viii) the resulting products produced by such systems or components, (ix) methods and apparatuses substantially as described hereinbefore and with reference to any of the accompanying examples, and (x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification are further intended to describe the metes and bounds of a limited number of embodiments of the invention and are not to be construed as the broadest embodiment of the invention or a complete listing of embodiments of the invention that may be claimed. The applicant does not waive any right to develop further claims based upon the description set forth above or in the drawings as a part of any continuation, division, continuation-in-part, or similar application.

The invention claimed is:

1. A score keeper and display device, comprising:

a panel having opposing panel front and rear faces;

first interconnected slots disposed within said panel to communicate between said panel front and rear faces;

a first marker configured to travel between said first interconnected slots, said first marker comprising first marker first and second ends and a first marker intermediate portion disposed therebetween, said first marker first and second ends comprising a greater outer perimeter than said first marker intermediate portion;

second interconnected slots disposed within said panel to communicate between said panel front and rear faces;

a second marker configured to travel between said second interconnected slots, said second marker comprising second marker first and second ends and a second marker intermediate portion disposed therebetween, said second marker first and second ends comprising a greater outer perimeter than said second marker intermediate portion;

a first entry port disposed within said panel to communicate (i) between said panel front and rear faces and (ii) with said first interconnected slots, said first entry port configured to receive said first marker, said first entry port sized such that said first marker first and/or second end can be passed therethrough; and a second entry port disposed within said panel to communicate (i) between said panel front and rear faces and (ii) with said second interconnected slots, said second entry port configured to receive said second marker, said second entry port sized such that said second marker first and/or second end can be passed therethrough.

2. The device of claim 1, wherein said first interconnected slots comprise a plurality of first slots interconnected with one another by a first interconnection.

3. The device of claim 2, wherein said first slots and said first interconnection dispose in coplanar relation.

4. The device of claim 2, wherein each of said first slots comprises a first slot longitudinal axis which passes through first slot opposing first and second ends.

5. The device of claim 4, wherein said first slot first end communicates with said first interconnection.

6. The device of claim 5, wherein said first slot second end provides a seat for said first marker.

7. The device of claim 1, wherein said first interconnected slots are completely laterally enclosed within said panel.

8. The device of claim 2, wherein said first slots and said first interconnection are completely laterally enclosed within said panel.

9. The device of claim 2, wherein a first interconnection longitudinal axis disposes in substantially parallel relation to a panel longitudinal axis.

10. The device of claim 4, wherein said first slots are disposed in angled relation to said first interconnection.

11. The device of claim 10, wherein said first slot longitudinal axis disposes in angled relation to a first interconnection longitudinal axis.

12. The device of claim 11, wherein said first slot first end angles upwardly from said first slot second end.

13. The device of claim 1, wherein upon disposition of said first marker within said first interconnected slots, said first marker is fixedly coupled to said panel to provide a unitary construct.

14. The device of claim 1, further comprising a panel support coupled to said panel, said panel support configured to support said panel in an upright position.

15. The device of claim 1, further comprising an auxiliary support coupled to said panel, said auxiliary support configured to support one or more auxiliary objects.

16. The device of claim 15, wherein said auxiliary support comprises a substantially planar surface which frontwardly extends from said panel front face.

17. The device of claim 16, wherein said auxiliary support comprises a pair of said substantially planar surfaces disposed in spaced apart relation.

18. A method of making a score keeper and display device, comprising:

providing a panel having opposing panel front and rear faces;

disposing first interconnected slots within said panel to communicate between said panel front and rear faces;

providing a first marker configured to travel between said first interconnected slots, said first marker comprising first marker first and second ends and a first marker intermediate portion disposed therebetween, said first marker first and second ends comprising a greater outer perimeter than said first marker intermediate portion;

disposing second interconnected slots within said panel to communicate between said panel front and rear faces;

providing a second marker configured to travel between said second interconnected slots, said second marker comprising second marker first and second ends and a second marker intermediate portion disposed therebetween, said second marker first and second ends comprising a greater outer perimeter than said second marker intermediate portion;

disposing a first entry port within said panel to communicate (i) between said panel front and rear faces and (ii) with said first interconnected slots, said first entry port configured to receive said first marker, said first entry port sized such that said first marker first and/or second end can be passed therethrough; and disposing a second entry port within said panel to communicate (i) between said panel front and rear faces and (ii) with said second interconnected slots, said second entry port configured to receive said second marker, said second entry port sized such that said second marker first and/or second end can be passed therethrough.

19. A method of using a score keeper and display device, comprising:

obtaining:

a panel having opposing panel front and rear faces;

first interconnected slots disposed within said panel to communicate between said panel front and rear faces;

a first marker configured to travel between said first interconnected slots, said first marker comprising first marker first and second ends and a first marker intermediate portion disposed therebetween, said first marker first and second ends comprising a greater outer perimeter than said first marker intermediate portion;

second interconnected slots disposed within said panel to communicate between said panel front and rear faces;

a second marker configured to travel between said second interconnected slots, said second marker comprising second marker first and second ends and a second marker intermediate portion disposed therebetween, said second marker first and second ends comprising a greater outer perimeter than said second marker intermediate portion;

a first entry port disposed within said panel to communicate (i) between said panel front and rear faces and (ii) with said first interconnected slots, said first entry port configured to receive said first marker, said first entry port sized such that said first marker first and/or second end can be passed therethrough; and a second entry port disposed within said panel to communicate (i) between said panel front and rear faces and (ii) with said second interconnected slots, said second entry port configured to receive said second marker, said second entry port sized such that said second marker first and/or second end can be passed therethrough;

supporting said panel on a surface in an upright position; and moving said first marker within said first interconnected slots to indicate a position of a first player of a game.

20. The method of claim 19, further comprising moving said second marker within said second interconnected slots to indicate a position of a second player of said game.

21. The device of claim 1, wherein each of said first and second markers is a one-piece construct.

* * * * *